US005511633A

United States Patent [19]

Aker

[11] Patent Number: 5,511,633

[45] Date of Patent: Apr. 30, 1996

[54] SAFETY DEVICE FOR PERSON AND GOODS LIFT AND TURNSTICK FOR SHIFTING OR RELEASE OF THE LIFTCAGE

[76] Inventor: Stein Aker, Borggaten 12B, N-0650 Oslo, Norway

[21] Appl. No.: 307,699

[22] PCT Filed: Apr. 7, 1993

[86] PCT No.: PCT/NO93/00060

§ 371 Date: Sep. 23, 1994

§ 102(e) Date: Sep. 23, 1994

[87] PCT Pub. No.: WO93/21097

PCT Pub. Date: Oct. 28, 1993

[30] Foreign Application Priority Data

Apr. 10, 1992 [NO] Norway ..... 921426

[51] Int. Cl.[6] ..... B66B 11/08

[52] U.S. Cl. ..... 187/263; 187/277

[58] Field of Search ..... 187/263, 277, 187/414, 289, 306, 280

[56] References Cited

U.S. PATENT DOCUMENTS 3,769,473 10/1973 Lay ..... 200/61.58 R
4,904,829 2/1990 Berthaud et al. ..... 200/50 R

FOREIGN PATENT DOCUMENTS 4037564 5/1991 Germany .
2179916 3/1987 United Kingdom .

*Primary Examiner*—Kenneth Noland
*Attorney, Agent, or Firm*—Young & Thompson

[57] ABSTRACT

The invention relates to a safety device for elevators, where an elevator turning wheel is connected to an elevator drive system comprised of an electric motor. The turning wheel is also coupled to a turn handle to move the elevator in the event of a power outage. The handle is also disposed in a holder containing a switch for connecting or disconnecting the supply of electric current to the elevator drive system.

9 Claims, 2 Drawing Sheets

Figure 1:
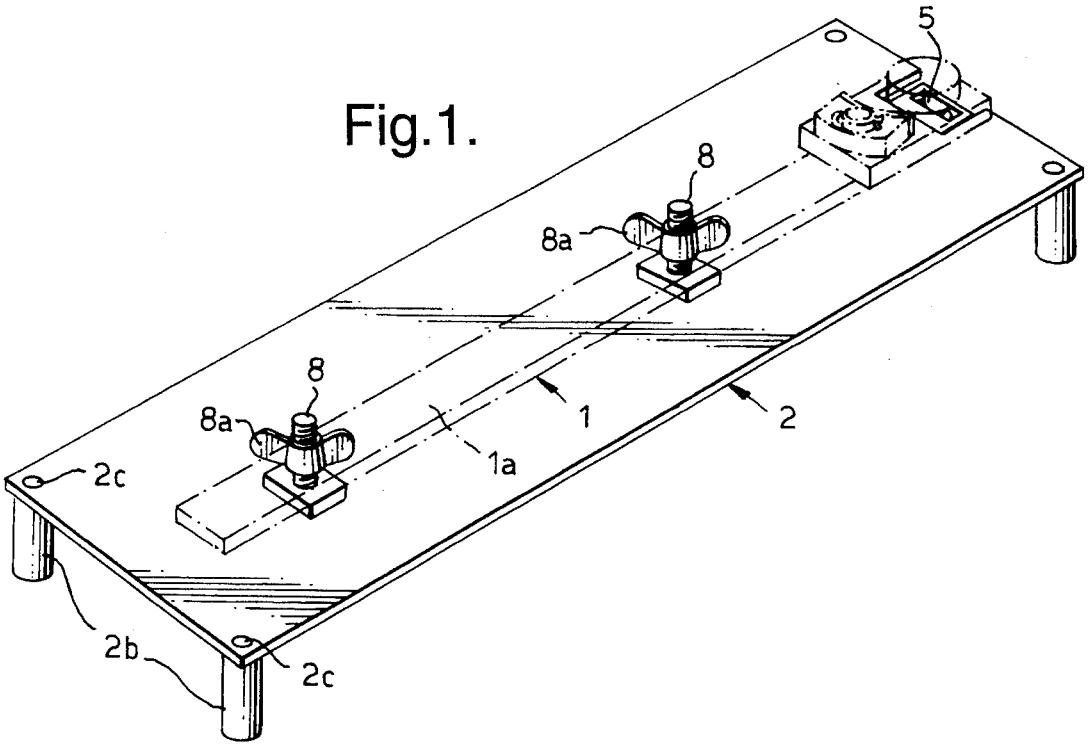

SAFETY DEVICE FOR PERSON AND GOODS LIFT AND TURNSTICK FOR SHIFTING OR RELEASE OF THE LIFTCAGE

The present invention relates to a safety device for a passenger/freight elevator of the shaft elevator type, where the elevator turning wheel connected to the elevator drive system comprising an electric motor is provided with a peripheral bead or peripheral axial flange for engagement with a turn handle for rotation of the turning wheel to move the elevator car in the event of a power outage, or in case the car is wedged or jammed in the elevator shaft, or when the elevator is being serviced.

There is previously known a turn handle comprising an arm having a head formed for engagement with the peripheral edge of the turning wheel, which edge comprises a peripheral axially extending flange projecting out to both sides of the turning wheel and adapted for engagement with the turn handle head, having means for positioning it against, respectively, the inside and outside of the flange. On exertion of a force on the shaft of the turn handle, said force is transferred via the flange of the elevator wheel and rotates the wheel, whereby when electric current is disconnected from the elevator drive system, the elevator may be moved up or down, or dislodged from a wedged position. A turn handle of the type mentioned above is known from Norwegian Design Application No. 63723.

Regardless of the particular reason that may exist for moving an elevator car with the aid of said turn handle, the elevator drive system must be disconnected from the electric current supply in order to prevent the possibility of a person's inadvertently starting the elevator by pushing the elevator control buttons, and thereby causing accidents because the unauthorized person presses on the control buttons and causes the elevator car to move.

The purpose of the present invention is to provide a safety device for passenger/freight elevators of the type mentioned in the introduction, whereby said possible starting of the elevator during servicing or other operations in connection with the elevator is prevented. According to the present invention, this is achieved by means of the characterizing features disclosed in the characterizing clause of the following independent claim 1 and in the subsequent dependent claims. The invention will be explained further In the following with reference to the drawings, which illustrate an example of the construction of a turn handle and a holder therefor, where the holder and turn handle are provided with cooperative actuating means for actuation of the connecting position of the switch.

Figure 2:
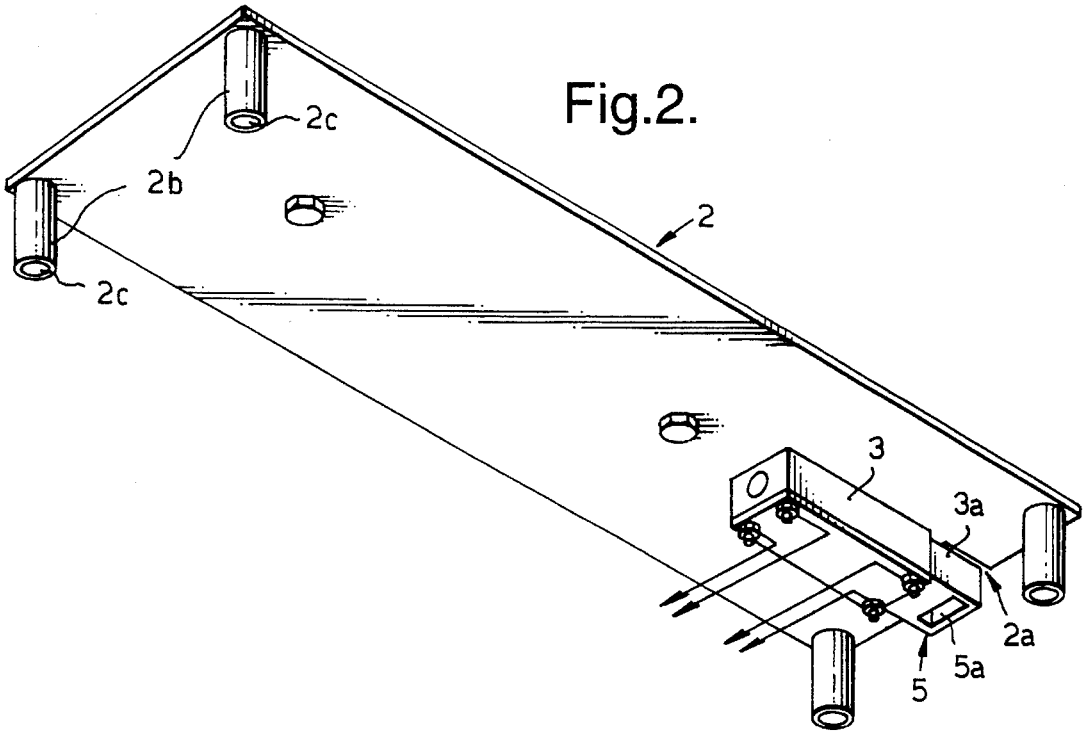
Figure 3A:
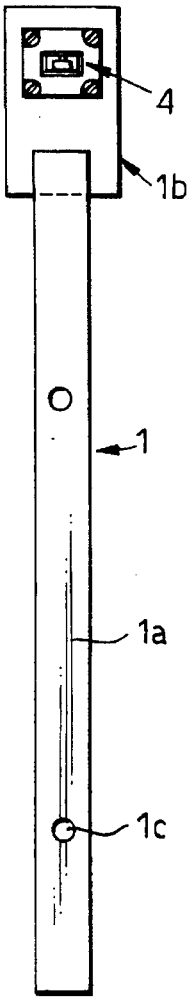
Figure 4A:
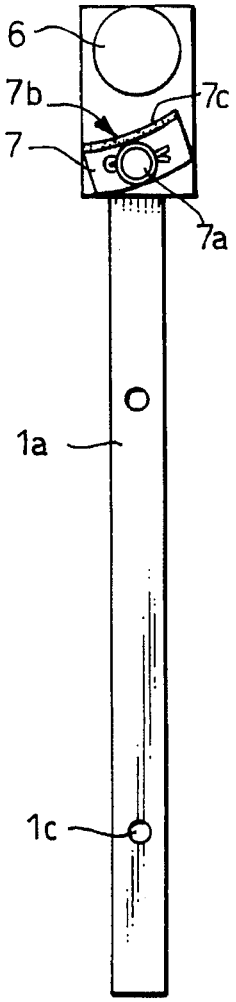

In the drawings,

FIGS. 1 and 2 show a perspective view of the holder from the front and the rear, respectively, with FIG. 1 also indicating the turn handle, drawn with a broken line, in secured position on the holder, FIGS. 3*a,b* shows a rear view and side view, respectively, of the turn handle with its projecting actuating means, and FIGS. 4*a,b* shows a front view and side view, respectively, of the turn handle without an actuating means.

FIG. 1 shows a holding plate 2 provided with legs 2*b* having through-going holes 2*c* for attachment to a wall in the elevator housing by means of screws or bolts. The holder 2 is provided with two spaced apart anchor bolts 8 at its center axis and with wing nuts 8*a* for the attachment of a turn handle 1, the shaft of which is provided with two holes 1*c* for engagement with said anchor bolts 8. In FIG. 1, turn handle 1 is indicated with broken lines, attached to the holder by means of said anchor bolts 8 and wing nuts 8*a*.

Figure 3B:
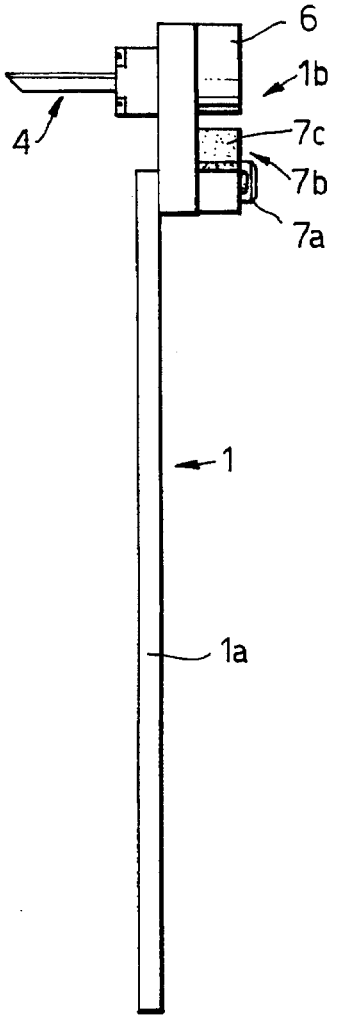

The indicated turn handle 1 is more clearly illustrated in FIG. 3 and comprises a shaft 1*a* and a head 1*b* at one end of the shaft. Head 1*b* for engagement with a flange or bead on the elevator turning wheel (not shown) is provided with a fixed jaw 6—preferably circular in shape—disposed transversely to the shaft 1*a*, and an elongated jaw 7 spaced therefrom and closer to the shaft, pivotable about a bolt 7*a*. When in use, head 1*b* of turn handle 1 will be positioned with jaws 6,7 on each side of the axial flange of the turning wheel, with the fixed jaw 6 on the inside of the flange. On application of a moment of force on the shaft 1*a* of turn handle 1, the pivotable jaw 7—shown in the drawing provided with a friction pad or lining 7*b* on its contact surface facing the turning wheel flange—will come into contact therewith, and the circular surface of the fixed jaw 6 will come into contact with the interior of the flange so that the turn handle head 1*b* engages the turning wheel flange and causes the turning wheel to rotate on application of said moment of force to the shaft 1*a* of turn handle 1. On relief of the rotational moment of force on shaft 1*a*, the engagement of jaws 6,7 on the turning wheel flange is released, whereupon the turn handle may be moved to a new position on the flange to execute a new rotational operation, etc., until the elevator car is, for example, brought to the desired position, e.g., in alignment with an elevator door, or has been dislodged from a wedged or jammed position in the elevator shaft.

As shown in FIG. 3, turn handle head 1*b* is provided with a projection 4 extending in the opposite direction of the first jaw 6 on the opposite side of said head. This projection constitutes an actuating means 4 adapted for cooperation with a second actuating means 5 which, in the exemplary embodiment shown in FIGS. 1 and 2, is constituted of an operating means of a switch 3, which, in form of an opening, alignes with an opening 2*a* in holder 2.

On insertion of the projecting actuating means 4 into said actuating means 5 in the operating means of the switch 3, the electrical contacts of the switch 3 will be connected, thereby connecting the electric current to the elevator drive system. On removal of turn handle 1 from holder 2, said actuating means 4 is drawn out of the switch operating means which forms actuating means 5, whereby the contacts of switch 3 are disconnected and the electric current to the elevator drive system is interrupted.

In this manner, as mentioned previously, the supply of electric current to the elevator is interrupted when turn handle 1 is removed from holder 2 during servicing of the elevator. Thus it is possible to prevent accidents which could otherwise occur with the unintentional starting of the elevator while the service work is taking place.

To prevent the use of a turn handle of the same type but from a different elevator unit in a first elevator system, the projection 4 on turn handle 1 may be designed with a particular cross profile complementary to the cross profile of an insertion opening 5*a* in the actuating means 5 that constitutes the operating means 3*a* for switch 3. This effectively prevents the possibility of using a random turn handle in an elevator unit for the connection of electric current by placing such a random turn handle 1 into holder 2.

The described actuating means 4 on the turn handle, and actuating means 5 for the switch 3, may of course be designed in a number of different ways. For example, the actual turn handle 1 may constitute the first actuating means 4 for engagement with the second actuating means 5 in form of, for example, a push button provided on holder 2, which button is depressed on positioning of the turn handle 1 in holder 2. When this button is depressed, the electric current to the elevator drive system is connected. On removal of the turn handle 1 from holder 2, the electricity is thereby disconnected.

In a further embodiment, the second actuating means 5 may constitute a pivotable arm connected to a switch, so that said arm, when in the position of actuation effected by placement of the handle in holder 2, maintains the switch connected, and on removal of turn handle 1 from holder 2, the arm pivots back and disconnects switch 3.

Figure 4B:
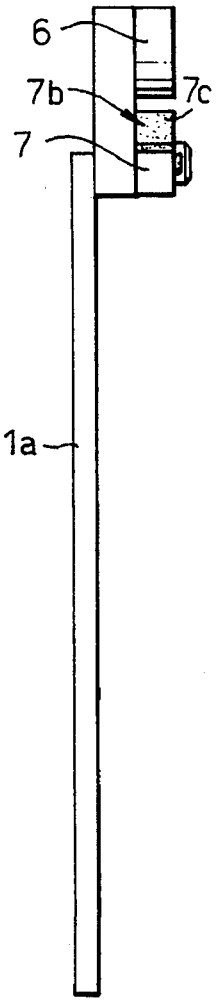

FIG. 4 shows the turn handle without actuating means 4, where the turn handle 1 itself can constitute the actuating means 4, or a particular actuating means 4 may be mounted on the turn handle in accordance with the individual elevator system for which the turn handle is to be provided.

From FIG. 4*a* it is clearly apparent how the pivotable, elongated jaw 7 on the head 1*b* of turn handle 1 is designed with a curved gripping surface 7*c*, with the inside of the curve facing toward the first jaw 6, and where gripping surface 7*c* is lined with a friction lining or pad 7*b* to secure the best possible engagement on the outer surface of the radial flange of the turning wheel on rotation of the turning wheel.

In connection with the fastening of the turn handle 1 onto the holder 2 by means of the aforementioned bolts 8 and wing nuts 8*a*, there may of course be provided a locking means therefor, e.g., in the form of a padlock that engages with aligned holes at the lower end of the turn handle and in the holder 2. In this way unauthorized persons are prevented from detaching the turn handle 1 and employing it on the turning wheel.

I claim:

1. Safety device for a passenger/freight elevator of the shaft elevator type, wherein an elevator turning wheel connected to an elevator drive system comprising an electric motor is provided with a peripheral bead or peripheral axially extending flange for engagement with a turn handle for rotation of the turning wheel to move an elevator car in the event of a power outage, or if the car is wedged or jammed in an elevator shaft, or when the elevator is being serviced, characterized in that the turn handle (1) is releasably disposed in a permanently mounted holder (2) containing a switch (3) for connection/disconnection of the supply of electric current to the elevator drive system, which connecting position for the switch (3) is actuated by the turn handle (1), the circuit being closed when the turn handle (1) is placed in the holder (2) and interrupted when the turn handle (1) is removed from the holder (2).

2. A safety device according to claim 1, characterized in that the turn handle (1) and the holder (2) have cooperative actuating means (4,5) for actuation of the connecting position of the switch (3).

3. A safety device according to claim 2, characterized in that a section of the turn handle (1) constitutes the first actuating means (4) for closing the switch (3) (completing the circuit) on pressure contact with the second actuating means (5) on the holder (2).

4. A safety device according to claim 3, characterized in the second actuating means comprises at least one rotatable arm (5) which when displaced by the placement of the turn handle (1) in the holder (2) closes the switch (3), completing the circuit.

5. A safety device according to claim 2, characterized in that the turn handle is provided with a projection extending transversely to its longitudinal direction, which projection constitutes the first actuating means (4) for insertion into an opening (2*a*) in the holder (2), in which is disposed the second actuating means (5) in the form of an operating means for a switch (3), whereupon by placement of the turn handle (1) in the holder (2), or removal thereof from the holder (1), the switch connection (3) is, respectively, closed or interrupted.

6. A safety device according to claim 5, characterized in that said projection (4) has a cross profile complementary to the cross profile of an insertion opening (5*a*) in the operating means (3*a*) for the switch (3), whereby the altering of the shape of the cross profile of the cooperative actuating means in various elevators prevents the effective use of the turn handle (1) from one elevator in a different elevator for connection of the electric current to the drive system.

7. A safety device according to claim 1, where the turn handle (1) consists of a shaft (1*a*) and a head (1*b*) for engagement with a flange or bead on the elevator turning wheel, characterized in that the head (1*b*) is provided with a fixed jaw (6) disposed transversely to the shaft and an elongated jaw (7) spaced therefrom and closer to the shaft (1*a*), pivotable about a bolt (7*a*), for placement with the jaws on each side of the axial flange on the turning wheel for engagement therewith on application of a moment of force on the shaft (1*a*).

8. A safety device according to claim 7, characterized in that the fixed jaw (6) has a circular cross section and that the pivotable jaw (7) has a curved gripping surface (7*b*) with the inside of the curve facing the fixed jaw (6), which gripping surface (7*b*) preferably is lined with a friction pad or lining (7*c*).

9. A safety device according to claim 1, characterized in that the holder (2) comprises at least one projecting threaded bolt (8) for engagement with a hole (1*b*) in the shaft (1*a*) of the turn handle (1) to secure the latter in place with the aid of a nut/wing nut (8*a*) and for optional locking thereof with the aid of known means.

* * * * *